United States Patent [19]

Grandy

[11] Patent Number: 4,785,740

[45] Date of Patent: Nov. 22, 1988

[54] DUAL PURPOSE WEAR PLATE

[75] Inventor: Robert S. Grandy, Hinsdale, Ill.

[73] Assignee: General Standard Company, Bensenville, Ill.

[21] Appl. No.: 51,905

[22] Filed: May 19, 1987

[51] Int. Cl.[4] ..... B61F 5/32

[52] U.S. Cl. ..... 105/225

[58] Field of Search ..... 105/218.1, 220, 225

[56] References Cited

U.S. PATENT DOCUMENTS

| | | | |
|---|---|---|---|
| 1,017,113 | 2/1912 | Slack . | |
| 1,343,618 | 6/1920 | Doerr | 105/220 |
| 1,680,498 | 10/1928 | Pflager . | |
| 2,295,520 | 9/1942 | Parke . | |
| 2,880,680 | 4/1959 | Quinn . | |
| 3,699,897 | 10/1972 | Sherrick | 105/218.1 |
| 3,834,320 | 9/1974 | Tack . | |
| 3,897,736 | 8/1975 | Tack . | |
| 4,078,501 | 3/1978 | Neumann et al. . | |
| 4,170,180 | 10/1979 | Houston . | |
| 4,192,240 | 3/1980 | Korpics . | |
| 4,203,371 | 5/1980 | Tack . | |
| 4,428,303 | 1/1984 | Tack . | |

*Primary Examiner*—Martin P. Schwadron
*Assistant Examiner*—Stephen M. Hepperle
*Attorney, Agent, or Firm*—Jones, Day, Reavis & Pogue

[57] ABSTRACT

A dual purpose wear plate for use in a railway truck, disposed between the pedestal jaw and the roller bearing adapter, consisting of a flat base portion having downwardly extending legs that protect the outboard lug and maintain the proper position of the wear plate.

7 Claims, 1 Drawing Sheet

DUAL PURPOSE WEAR PLATE

BACKGROUND OF THE INVENTION

This invention relates generally to a wear plate for use in the side frame structure of a railway truck. A typical railway car is supported by two trucks with one truck supporting each end of the car. Each truck consists of a pair of parallel pedestal side frames, each side frame having two downwardly opening jaws. The side frames are connected together by bolsters to form a substantially rectangular frame structure on which the car sits. This frame structure rides on wheels that are supported by bearing assemblies located in each of the jaws.

Each bearing assembly consists of a roller bearing adapter that is free to slide in the vertical direction relative to the jaw. The roller bearing adapter rests on a roller bearing that, in turn, rotatably supports the axles that carry the wheels.

The lateral and longitudinal movement of the adapter within the jaw in constrained by a pair of lugs, located on the jaw walls, that are engageable with a pair of mating channels formed in the roller bearing adapter. However, because of necessary design tolerances, some clearance remains between the mating components. As a result, the roller bearing adapter is able to slide relative to the side frame causing objectionable wear on the pedestal jaw roof and adapter crown.

In addition to the wear on the pedestal jaw roof and adapter crown, an objectionable amount of wear also occurs on the outboard lug. This wear results when the braking force that is applied to the wheel forces the adapter into contact with the outboard lug such that the adapter rubs against the lug.

Wear plates have been designed that can be inserted between the roller bearing adapter and the pedestal to protect the pedestal jaw roof and adapter crown. However, certain wear plates are made undesirably rigid by the means employed to fix the wear plate in the proper position. Some methods of attachment can generate areas of high stress in the wear plates rendering them susceptible to fracturing under the shifting loads caused by the movement of the bearing unit within the pedestal jaw. Once the integrity of the wear plate breaks down, the wear plate may be able to move from its proper position thereby reducing the amount of protection provided. Moreover, the uneven surface of a cracked wear plate can actually increase the wear on the adapter and side frame.

Furthermore, the railroad industry has not developed a protective device for the outboard lug, having instead to rebuild the worn lug by a welding process. This rebuilding process is a slow and expensive operation that requires the truck to be idled and dismantled while it is performed.

Therefore, it is apparent that there is a need in the railway industry for a wear plate that can protect the adapter crown, pedestal jaw roof and outboard lug.

SUMMARY AND OBJECTS OF THE INVENTION

This invention solves the above-noted shortcoming of the prior art by providing a dual purpose wear plate that protects the pedestal jaw roof, adapter crown, and outboard lug. A second embodiment of the invention also protects the inboard lug. The device consists, generally, of a flat base portion having downwardly extending legs that protect the lugs and maintain the proper position of the wear plate. This design protects the critical areas of the side frame structure without generating areas of high stress that are susceptible to cracking. These high stress areas are not generated because the proper position of the dual purpose wear plate can be maintained without welds or gripping fingers located along the length of the flat base portion.

It is a general object of the invention to provide an improved wear plate for use between the pedestal side frame jaw and the roller bearing adapter of a train truck.

It is a further object of the invention to provide a novel wear plate that protects the pedestal jaw roof, roller bearing adapter crown, and outboard lug.

It is still a further object of the invention to provide a novel wear plate that can flex under the changing loads generated by the movements of the components without generating areas of high stress.

It is yet another object of the invention to provide a novel wear plate that can be installed without tools and without any modification of the pedestal side frame.

It is still another object of the invention to provide a novel wear plate that increases the bearing area contacted by the roller bearing adapter.

It is yet a further object of the invention to provide a novel wear plate that will not move from the installed position during use.

Other objects of the invention, in addition to those set forth above, will become apparent to those skilled in the art from the following description.

DETAILED DESCRIPTION OF THE INVENTION

Figure 1:
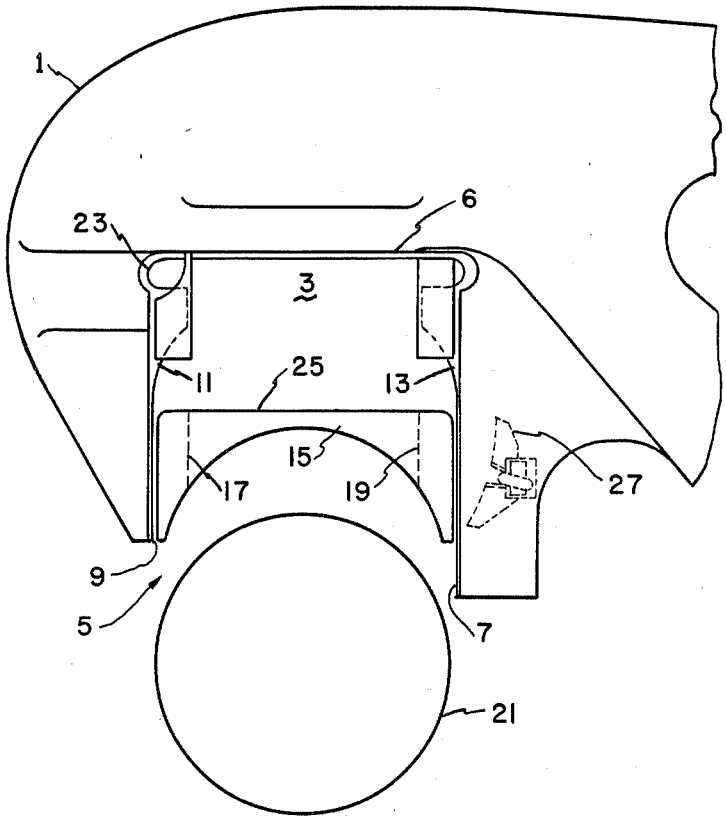
FIG. 1 is an exploded view of one end of a pedestal-type side frame including a first embodiment of the dual purpose wear plate of the invention.

Referring more particularly to the drawings, FIG. 1 shows a portion of the pedestal side frame 1 including the downwardly opening jaw 3 and the bearing unit 5. Disposed between the pedestal side frame 1 and the bearing unit 5 is the first embodiment of the dual purpose wear plate 6 of the invention. While only one jaw 3 and bearing unit 5 are shown and discussed, it should be understood that each side frame 1 has two identical assemblies.

Located on the jaw walls 7 and 9 are a pair of diametrically opposed lugs 11 and 13. The bearing adapter 15 slides vertically into the jaw 3 such that channels 17 and 19 mateably engage lugs 11 and 13 to thereby limit the lateral and longitudinal movement of the adapter 15.

The adapter 15 rests on a roller bearing 21 that carries the axle that, in turn, supports the wheels, not shown. Due to the design tolerances of this assembly, the adapter 15 is able to move a limited distance in the lateral and longitudinal directions. Over a sustained period of time, this movement causes objectionable wear on the pedestal jaw roof 23 and the adapter crown 25. Also, the outboard lug 11 is subject to wear due to contact with the adapter 15 when a braking force is applied by shoe 27.

Figure 2:
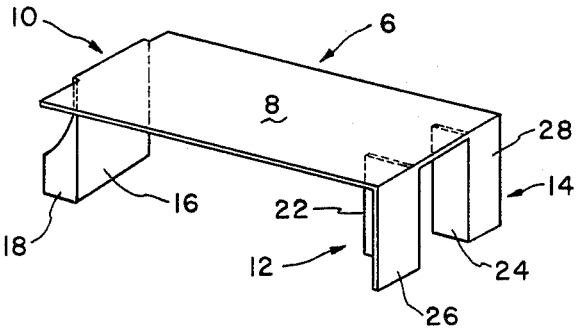
FIG. 2 is a perspective view of the first embodiment of the dual purpose wear plate of the invention.
Figure 3:
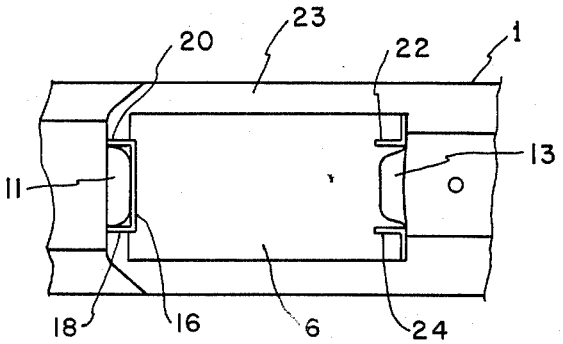
FIG. 3 is a bottom view of the pedestal-type side frame and the first embodiment of the dual purpose wear plate of FIG. 1 with the bearing unit removed.

To protect these components, the dual purpose wear plate 6 of this invention is disposed between the adapter 15 and the jaw roof 23. Preferrably, the wear plate 6 is formed from a single piece of flat iron or other suitable material that is cut and bent into the configuration shown in FIG. 2. It is also contemplated that the wear plate be made of molded plastic. Specifically, the wear plate 6 consists of a flat base portion 8 from which legs 10, 12 and 14 extend perpendicularly. The outboard leg 10 is formed with a front face 16 and two parallel side faces 18 and 20. The faces are dimensioned such that the outboard leg 10 surrounds the outboard lug 11 as shown in FIG. 3.

The inboard legs 12 and 14 include side faces 22 and 24, respectively, that define a space therebetween dimensioned to snugly receive the inboard lug 13. The back faces 26 and 28 are disposed perpendicularly to the side faces 22 and 24 and abut the wall 7 of the jaw 3 adjacent the inboard lug 13.

When the wear plate 6 is installed in the pedestal jaw 3, the base portion 8 contacts the jaw roof 23; the outboard leg 10 surrounds the outboard lug 11; the inboard legs 12 and 14 receive the inboard lug 13 therebetween; the adapter crown 25 abuts the base portion 8 from below; and the channels 17 and 19 trap the faces of the legs 10, 12 and 14 against the respective lugs. Therefore, the downwardly extending legs maintain the lateral and longitudinal position of the wear plate such that it is not necessary to secure the wear plate to the side frame using welds or gripping fingers. As a result, the base portion 8 can freely flex along its entire length without generating the high stress areas that cause the cracking in the prior art devices.

Furthermore, the legs 10, 12 and 14 provide a larger bearing area to cooperate with the channels 17 and 19 of the adapter 15. The wear plate 6 can also take up excess clearance between the adapter and the jaw 3. Thus, the wear plate 6 makes the bearing unit 5 and side frame structure 1 a more stable unit.

Figure 4:
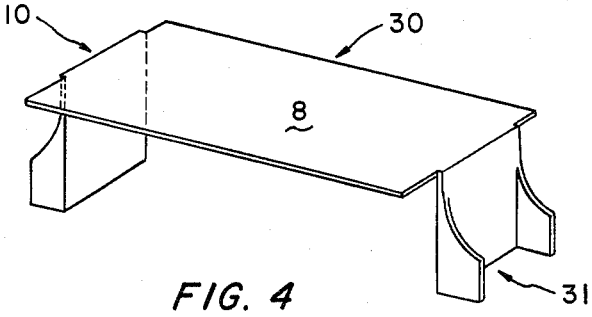
FIG. 4 is a perspective view of a second embodiment of the dual purpose wear plate of the invention.

A second embodiment of the dual purpose wear plate is shown, generally, at 30 in FIG. 4. The wear plate 30 consists of a flat base portion 8 and a downwardly extending leg 10 both of which are identical to the like referenced components of the first embodiment. However, the downwardly extending legs 12 and 13 of the first embodiment are replaced by leg 31 that is identical to leg 10. The leg 31 will surround the inboard lug 13 in the same manner as leg 10 surrounds the outboard lug 11. Thus, a symmetrical wear plate results that protects both the inboard lug 13 and outboard lug 11. The symmetrical design also facilitates installation of the wear plate because it cannot be installed in the wrong orientation.

It should be understood that changes, variations and modifications may be effected in the details and operation of the present invention without departing from the spirit and scope thereof, as defined in the appended claims.

What is claimed is:

1. In a pedestal side frame of the type having a downwardly facing jaw including a roof portion and opposed sidewall portions extending downwardly from said roof portion, a first lug located on one of said sidewall portions, a second lug located on the other of said sidewall portions opposite the first lug, a bearing adapter adapted to be received in said jaw including a first vertically extending channel for slidably receiving the first lug and a second vertically extending channel for slidably receiving the second lug thereby to retain the bearing adapter in the jaw, and, disposed between said jaw and said bearing adapter, an improved wear plate, comprising:

a base portion abutting said roof portion;

a first leg formed integrally and extending downwardly from said base portion and located in said first channel between said first lug and said bearing adapter, said first leg comprising two faces extending from a central connecting face at an angle of less than 180 degrees, said leg enclosing the first leg to prevent all contact between said first lug and said bearing adapter; and second and third legs extending downwardly from said base portion and disposed one each on either side of said second lug such that the engagement of said second lug with said second and third legs limits movement of the wear plate in a plane parallel to said base portion.

2. The pedestal-type side frame of claim 1 wherein said wear plate is formed of a single piece of material.

3. The pedestal-type side frame of claim 1 or wherein said second and third downwardly extending legs include faces that abut the jaw walls adjacent the other of said lugs.

4. In a pedestal side frame of the type having a downwardly facing jaw including a roof portion and opposed sidewall portions extending downwardly from said roof portion, a first lug located on one of said sidewall portions, a second lug located on the other of said sidewall portions opposite the first lug, a bearing adapter adapted to be received in said jaw including a first substantially C-shaped channel for receiving the first lug and a second substantially C-shaped channel for receiving the second lug to thereby retain the bearing adapter in the jaw, and a wear plate disposed between said jaw and said bearing adapter comprising:

a base portion abutting said roof portion;

a first leg formed integrally and extending downwardly from said base portion having a substantially C-shaped cross-section as taken in a plane parallel to said base portion dimensioned to be received within said first channel and to receive said first lug, said first leg being located in said first channel between said bearing adapter and said first lug to prevent all contact between said first lug and said contact between said first lug and said adapter; and second and third legs extending downwardly from said base portion and disposed one each on either side of said second lug such that the engagement of said second lug with said second and third legs limits movement of the wear plate in a plane parallel to said base portion.

5. In a pedestal side frame of the type having a downwardly facing jaw including a roof portion and opposed sidewall portions extending downwardly from said roof portion, a first lug located on one of said sidewall portions, a second lug located on the other of said sidewall portions opposite the first lug, a bearing adapter adapted to be received in said jaw including a first vertically extending channel for receiving said first lug and a second vertically extending channel for receiving said second lug to retain the bearing adapter in the jaw, and a wear plate disposed between the jaw and the bearing adapter, comprising:

a base portion abutting said roof portion;

a first leg formed integrally and extending downwardly from said base portion and located in said first channel between said first lug and said bearing adapter, said first leg comprising two faces extending from a central connecting face a an angle of less than 180 degrees, said leg surrounding the first lug to prevent all contact between said first lug and said bearing adapter; and a second leg formed integrally and extending downwardly from said base portion and located in said second channel between said second lug and said bearing adapter, said second leg comprising two faces extending from a central connecting face a an angle of less than 180 degrees, said leg surrounding said second lug to prevent all contact between said second lug and said bearing adapter.

6. The pedestal-type side frame of claim 5 wherein said first and second downwardly extending legs are identical.

7. The pedestal-type side frame of claim 6 wherein said wear plate is formed of a single piece of material.

* * * * *